US010675219B2

(12) United States Patent
Spallek et al.

(10) Patent No.: US 10,675,219 B2
(45) Date of Patent: Jun. 9, 2020

(54) TRANSFER SYSTEM FOR CONTAINERS

(71) Applicant: KOCHER-PLASTIK MASCHINENBAU GMBH, Sutzbach-Laufen (DE)

(72) Inventors: Michael Spallek, Ingelheim (DE); Johannes Geser, Gerlingen (DE); Karl Koeppel, Rainau (DE); Alexander Hammer, Gaildorf (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 73 days.

(21) Appl. No.: 15/570,783

(22) PCT Filed: May 6, 2015

(86) PCT No.: PCT/EP2015/000922
§ 371 (c)(1),
(2) Date: Oct. 31, 2017

(87) PCT Pub. No.: WO2016/177384
PCT Pub. Date: Nov. 10, 2016

(65) Prior Publication Data

US 2018/0116908 A1 May 3, 2018

(51) Int. Cl.
*A61J 1/14* (2006.01)
*A61J 1/20* (2006.01)

(52) U.S. Cl.
CPC ..... *A61J 1/1437* (2013.01); *A61J 1/1412* (2013.01); *A61J 1/201* (2015.05); *A61J 1/2013* (2015.05); *A61J 1/2089* (2013.01); *A61J 1/2051* (2015.05)

(58) Field of Classification Search
CPC .... A61M 2205/6045; A61M 2039/1077; A61J 1/2096; A61J 1/2089; A61J 1/2013; A61J 1/1437
See application file for complete search history.

(56) References Cited

U.S. PATENT DOCUMENTS 4,150,673 A * 4/1979 Watt ..... A61J 1/10 128/DIG. 24
4,614,437 A * 9/1986 Buehler ..... B01F 13/002 141/319
4,619,640 A * 10/1986 Potolsky ..... A61M 39/10 128/912
(Continued)

FOREIGN PATENT DOCUMENTS

EP 0 843 992 5/1998
WO 95/00101 1/1995
(Continued)

OTHER PUBLICATIONS

International Search Report (ISR) dated Jan. 27, 2016 in International (PCT) Application No. PCT/EP2015/000922.

*Primary Examiner* — Timothy P. Kelly
(74) *Attorney, Agent, or Firm* — Wenderoth, Lind & Ponack, L.L.P.

(57) ABSTRACT

A transfer system for containers comprises at least a first container (1) and at least a second container (5) that can be interconnected in a media-transferring way by a connection system (7). An encryption system (13, 21, 25, 31) is provided to allow or prevent a media-transferring connection between the respective assignable containers (1, 5).

21 Claims, 15 Drawing Sheets

(56) References Cited

U.S. PATENT DOCUMENTS

| | | | | |
|---|---|---|---|---|
| 5,826,713 | A | 10/1998 | Sunago et al. | |
| 2002/0173748 | A1* | 11/2002 | McConnell | A61J 1/2096 604/167.02 |
| 2003/0078195 | A1 | 4/2003 | Kristensen et al. | |
| 2008/0138376 | A1* | 6/2008 | Harman | A61J 1/1406 424/423 |
| 2009/0069783 | A1* | 3/2009 | Ellstrom | A61M 39/10 604/415 |
| 2009/0099552 | A1* | 4/2009 | Levy | A61M 39/10 604/533 |
| 2012/0103469 | A1* | 5/2012 | Terwilliger | A61J 1/14 141/346 |
| 2013/0096510 | A1 | 4/2013 | Plumptre et al. | |
| 2013/0306191 | A1* | 11/2013 | Metzmaker | A61J 1/2096 141/2 |
| 2016/0008536 | A1* | 1/2016 | Gravesen | F16L 29/02 604/151 |
| 2018/0153772 | A1* | 6/2018 | Spallek | A61J 1/2089 |

FOREIGN PATENT DOCUMENTS

| | | |
|---|---|---|
| WO | 2011/131780 | 10/2011 |
| WO | 2015/075221 | 5/2015 |

* cited by examiner

TRANSFER SYSTEM FOR CONTAINERS

FIELD OF THE INVENTION

The invention concerns a transfer system for containers with at least a first and at least a second container that can be interconnected in a media-transferring way by a connection system.

BACKGROUND OF THE INVENTION

Systems of this kind permit bringing certain media, which are ingredients of separate containers, into contact or to mix them via the connection system. Such processes are carried out widely in the medical and pharmaceutical fields for the purpose of providing preparations that have at least two separate components that have to be mixed prior to their use. A particularly widespread field of application concerns the production of preparations for parenteral application for medical or diagnostic purposes. In the production of preparations for infusions, for example in an infusion bottle, it is often necessary to add to the solvent that is present in the infusion bottle, such as water, an isotonic saline solution, a glucose solution, a Ringer's lactate solution or such like, a drug, for example an antibiotic, in liquid or powder form, which needs to be mixed with the solvent or dissolved therein. Particularly in the medical field, it is critical that errors are avoided in this process. These errors are described in detail, for example, by E. A. Flynn et al. in "Observational Study of Accuracy in compounding IV mixtures at five hospitals" (Am J Health-Syst Pharm Vol 54, Apr. 15, 1997, 904-912) on page 906. According to this publication, they include among others: wrong drugs, wrong dosage, wrong solvent volume, wrong solvent composition, and wrong reconstitution process. Moreover, Richard Bateman et al. point out in the publication "Errors associated with the preparation of aseptic products in UK hospital pharmacies . . . " (Qual Saf health care 2010; 19: e 29) and D. H. Cousins et al. in the publication "Medication errors in intravenous drug preparation and administration . . . " (Qual Saf Health Care 2005; 14: 190-195) the current shortcomings concerning medical safety in parenteral applications.

Moreover, for logistical reasons, the different components of the drug being stored separately from each other is particularly desirable, if the component has to be kept chilled. Chilling is often the case with sensitive biotechnological products, which have to be dissolved prior to parenteral administration as infusion to avoid having to extend the cold chain to the solvent.

SUMMARY OF THE INVENTION

With regard to this challenge, an object of the invention is to provide an improved transfer system for containers that largely excludes the possibility of wrong combinations.

According to the invention, the object is basically met by a transfer system for containers, having as a significant feature of the invention, an encryption system that allows or prevents a media-transferring connection between the respective assignable containers. An incorrect combination of media is excluded due to the encryption.

In a particularly advantageous manner, the encryption system may be operative between a container and the connection system.

High operational reliability and a simple construction can be achieved through an encryption system that is based upon the mechanical lock and key principle.

Particularly advantageously in this respect may be to provide at least one key element with physical coding on a container, through which a suitably coded locking element, located on the connection system, can be unlocked. The connection system prevents in the locked state the connecting function of the connection system. The locking element in this instance is the lock of the lock and key system.

The arrangement may advantageously have the locking element in its locked state preventing the opening movement of a hollow puncture spike of the connection system that establishes the media connection between the containers, and thus, prevents the media connection.

The key element associated with the container may, in an advantageous manner, be formed by a cap section that surrounds a perforable opening section of the respective container. The cap section is provided on its outside with irregular form features that correspond to a code.

In particularly advantageous exemplary embodiments, the locking element provides, as lock for the key element of the cap section, a body with an opening. The opening is provided on the inside with coded, irregular form features in such a way that the cap section can be inserted into an operating position in which the media connection of the containers can be established, provided that the coding of its key element matches.

It is essential in this instance that the coding interrogation of key element and locking element must happen with little force and along a short, straight path to keep the application as intuitive and simple as possible and to avoid misalignment. Moreover, it is advantageous if there is a redundancy of coding provided in the key and the locking element, for example 2-fold or 3-fold, which is evenly distributed over the circumference and which prevents misalignment and makes orientation during insertion easier.

In order to transfer the locking element into the unlocked state, the connection system may be provided with at least one latching member that engages with the opening of the locking element. The latching member, when reaching the operating position, may be unlocked by the cap section that is inserted through the opening of the locking element in order to release the locked state of the hollow puncture spike.

In a particularly advantageous manner, the irregular form features, which provide the coding, may be provided in form of recesses and protrusions. For example, the coding of the key element on the cap section is provided at its circumference with recesses and/or protrusions. The coding of the locking element is formed on the wall of its opening with protrusions and/or recesses that are complementary to the coding of the recesses and/or protrusions of the cap section.

With particular advantage, the arrangement may be such that the coding has at least two subgroups, each with at least one recess and/or one protrusion. The subgroups are spatially offset from one another and characterize one and/or more different particularities of both containers, as mentioned previously (drug, dosage, solvent volume, solvent composition etc.).

Moreover, the arrangement may advantageously have the shape of the cap section on its outer circumference and the opening of the body of the locking element corresponding to a Reuleaux triangle with rounded ends. Coding is provided on each of the three sides. Examples of this kind are characterized by being particularly user-friendly since there is for the insertion process not a single, unambiguous insertion position dictated by container and connection system, but three inserting positions are available.

It is of particularly advantage to design the coding of the annular body (25) in form of straight protrusions that extend along a longitudinal axis. The cap (13) is in form of straight recesses of varying width that extend along a longitudinal axis.

This coding allows for functions that are akin to those of mechanical locking facilities with master keys and slave keys. With respect to the present invention, a coding of a cap (13) may then fit into multiple different code formations of different annular bodies (25).

Thus it may, for example, be possible that a drug M1 in powder form is to be combinable with three different solvents L1, L2, L3 (1:3 allocation), whereas a different drug M2 is only allowed to be combined with the different solvents L1, L2 (1:2 allocation), and again a different drug M3 may only be allowed to be combined with the solvent L1 (1:1 allocation).

For the locking elements (solvents) and the key elements (drugs) in this example, the following is possible, for example:

Solvent L1 protrusion width 2 mm; solvent L2 protrusion width 3 mm,

Solvent L3 protrusion width 4 mm and

Drug M1 recess width 4 mm; drug M2 recess width 3 mm, Drug M3 recess width 2 mm.

The wide recess of M1 permits the insertion of the protrusion of L1, L2 and L3, whereas for M2 this is only achieved with L2 and L1 (the wider protrusion of L3 blocks), and for M3 only L1 is possible (wider protrusions of L1 and L2 block).

Analogously, the further, above-described particularities may be allocated securely with additional code formations in form of protrusions and recesses of varying geometry at different positions of cap (13) and annular body (25) respectively (n:p allocations).

Another object of the invention is an encryption system for a transfer system for containers, wherein the respective encryption system bears certain characteristics.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
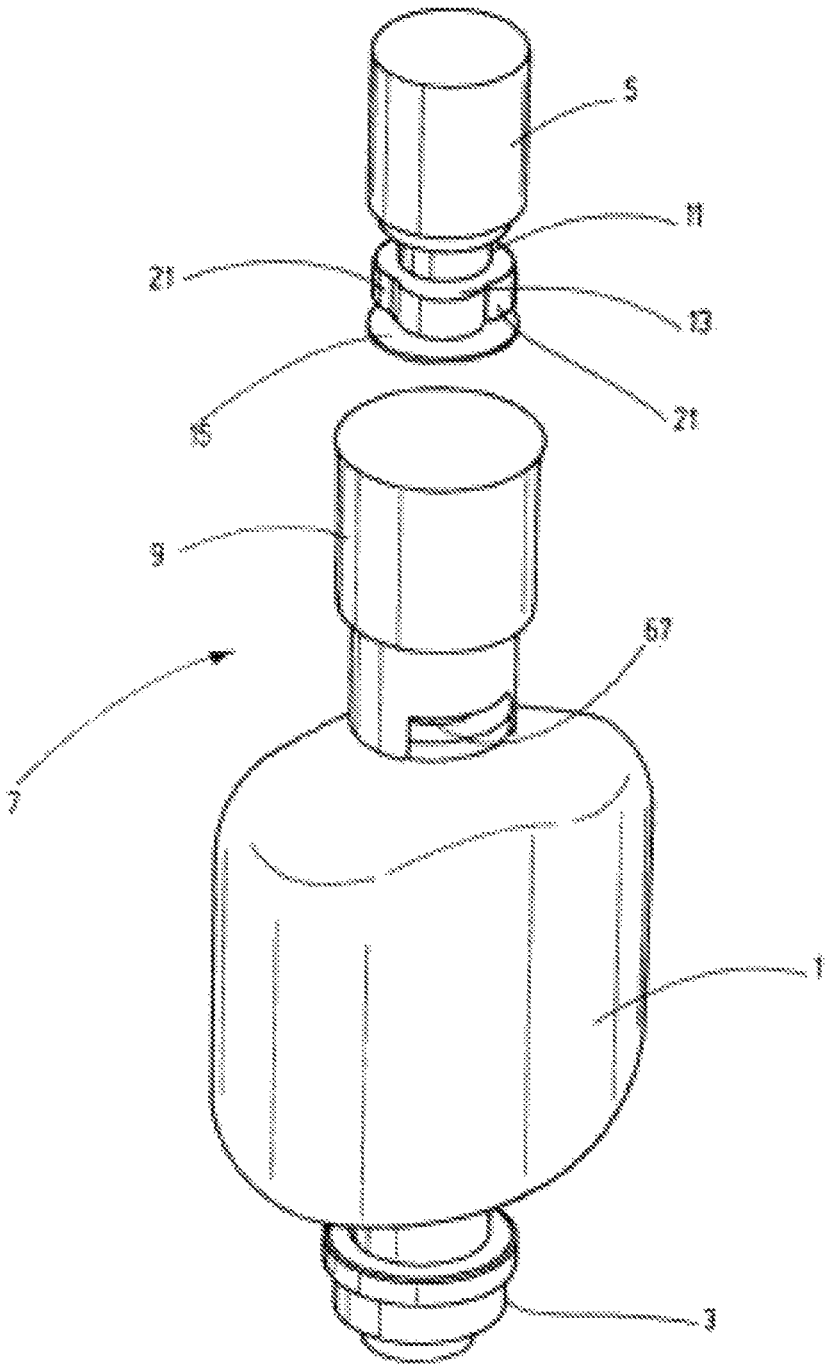
FIG. 1 is a perspective view of a transfer system for containers according to an exemplary embodiment of the invention.

The invention will now be explained in greater detail by way of exemplary embodiments, in which the transfer system for a media exchange between containers is provided. The containers are preferably used for medical, diagnostic, enteral or parenteral applications. The specific exemplary embodiments shown in the drawings depict in this respect (see in particular FIG. 1) a first container in form of an infusion container 1 in form of a plastic container, which is manufactured, for example, according to the known blow-fill-seal method, described for example in EP 2 269 558 A1, and which is also known to those skilled in the art as a Bottlepack® system. Containers of this kind are usually provided with at least one connection 3 for an infusion set. Certain safety criteria must be met if a further liquid or powdery media component is to be added to the content of the infusion container 1, which may, for example, contain a certain volume of a solvent for the preparation of a specific infusion liquid.

In medical or diagnostic applications, it is important that attention is paid not only to sterility at the media transition between an additional component, which in applications of this kind is located in a glass or polymer bottle 5, but it also must be ensured that the media transition takes place from a bottle 5, which contains a certain quantity of the required substance, into an infusion container 1. To achieve a corresponding, simple and sterile transfer process, provision may be made, as disclosed in document WO 95/00101, that a connection system can be or is attached to the infusion container 1. The connection system comprises a transfer device with a hollow puncture spike in form of continuous passages that pass through between perforating spikes, which is normally locked in a non-operating position. Both perforating spikes of the hollow puncture spike are located at a distance from a perforable opening section of the infusion bottle 1 and a perforable perforation section of the bottle 5 that is intended for the transfer process. The connection system has a largely cylindrical, sleeve-like seat into which the bottle 5, which is provided for the transfer process, may be inserted. The sleeve-shaped seat forms a guide for the movement of bottle 5. The perforable opening section of bottle 5 approaches the hollow puncture spike, unlocks the lock of the transfer device and moves the same into an end position in which the hollow puncture spike perforates the opening sections of bottle 5 and infusion bottle 1 and thus creates the media connection.

The transfer system for containers is to that extent based upon the same operating principle. Nevertheless, the basic difference of the invention lies in the fact that the unlocking of the transfer device 27 in the Figures, and thus the enabling of a media-transferring connection, is only possible when using a moveable container that is designed particularly for the respective transfer process, that is, the bottle 5. In the invention specific controls are provided on the moveable bottle 5 through which the locking device of the transfer device may be unlocked. Thus, the danger of an operating error, which is possible with the described prior art, that is, a media transfer of prohibited substances and/or volumes, is precluded through an encryption between bottle 5 and connection system 7. Details of such an encryption between the bottle 5 and the connection system 7 that is made possible by the invention become apparent from the further FIGS. 2 et. seq.

Figure 2:
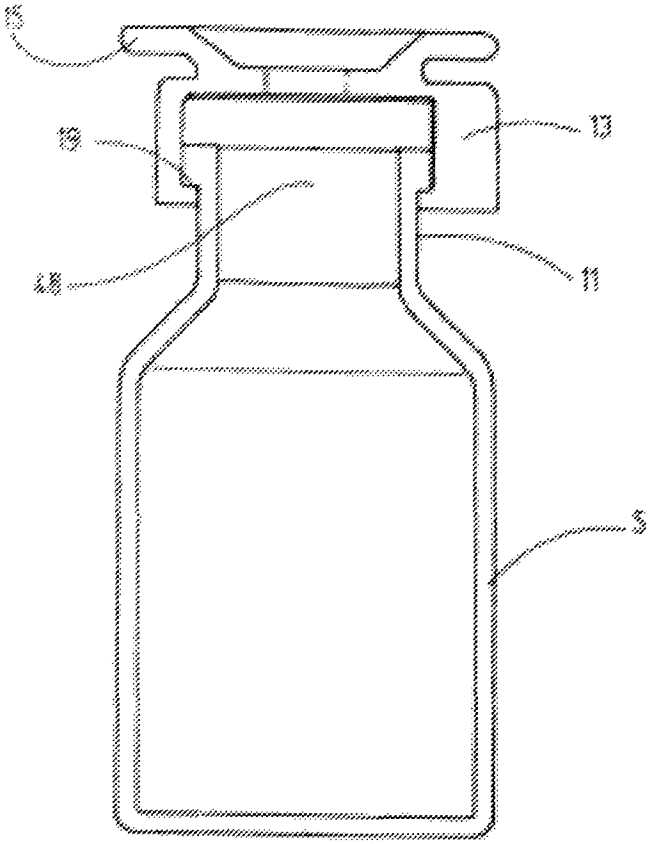
FIG. 2 is a schematically simplified, side view in section of a container in form of a bottle containing a media component, the content of which is to be transferred by the transfer system of FIG. 1 into a second container.
Figure 3:
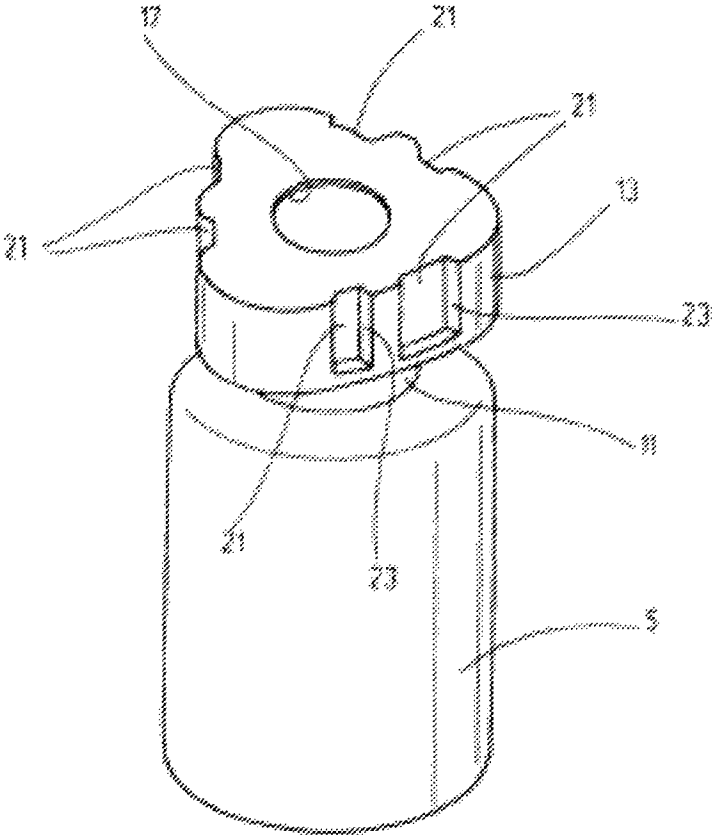
FIG. 3 is a perspective view of the bottle in FIG. 2, depicted with the cap cover removed.

FIGS. 2 and 3 show a moveable bottle 5 separately. The neck part 11 of bottle 5 has a perforable opening section 48 disposed therein, for example in form of an elastomeric plug that is not depicted in great detail. A cap section 13 is attached to the neck part 11, which cap section in the present example is a single-piece, injection-molded plastic part. The FIGS. 1 and 2 depict the cap section 13 in its initial state prior to use. The top of the cap section 13 is provided with a molded-on cover 15 as an authenticity mark, which cover may be easily removed mechanically by the user prior to using the bottle 5. A removable foil can be provided instead of the cover 15. On removing the cover 15, a central opening 17 is revealed on the cap section 13, which is flush with the perforable opening section 48 on the neck section 11 of the bottle 5. If a radiation-permeable foil is provided instead of the cover 15, such foil may be radiated with high-energy radiation, e.g., UV radiation or beta radiation, so as to kill any germs that may be present on the elastomer surface (perforation surface). The cap section 13, which is preferably made from a polymer, may be clipped to the edge of the neck part 11 of the bottle 5, as shown in FIG. 2. Alternatively, the caps 13, with code formations according to the invention, may be part of multi-piece plastic caps that are known per se and are as described in WO 2011/032798 A1, WO 2011/039004 A1 and EP 0655042 B1, which are used with particular advantage for freeze-drying of drugs or medical products.

Figure 7:
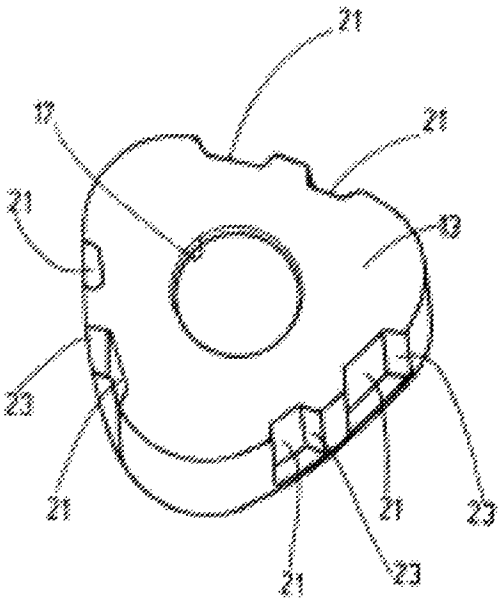
FIG. 7 is a perspective view of the cap section with the cap cover of the moveable bottle removed, with view onto the free end face of the exemplary embodiment.
Figure 8:
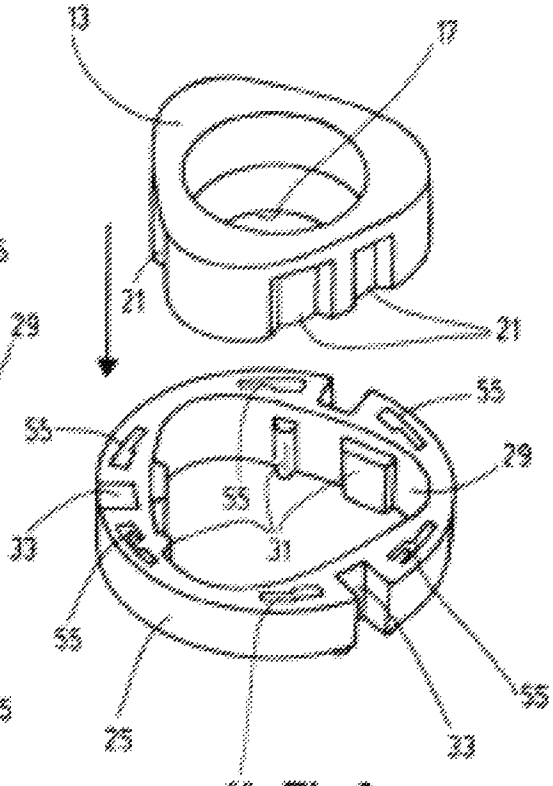
FIG. 8 is a pulled-apart, perspective view of the encryption system of FIG. 1 that operates according to the lock and key principle, wherein the cap section of FIG. 7 that forms the key element is depicted prior to insertion into the locking element of FIG. 6, which acts as the lock of the system.

The outline of the cap section 13 has the shape of a Reuleaux triangle with rounded corners. To provide the encryption according to the lock and key principle, the cap section 13 forms with the outer circumference of the Reuleaux triangle a physically coded key element. The coding on the cap section 13 is formed through recesses 21. The recesses 21 take the form of grooves that are recessed inwards from the circumference. The circumference length of these grooves are limited by the walls 23, which define, with respect to the opening 17, radial planes of which only in FIG. 7 some walls 23 are referenced. The axial depth of the recesses 21 is less than the thickness of the cap section 13, so that the recesses 21 are open at the end face that is apparent in FIG. 7, and the side of the cap section 13 that faces the main part of the bottle 5 is free of recesses 21, as shown in FIG. 8.

Figure 5:
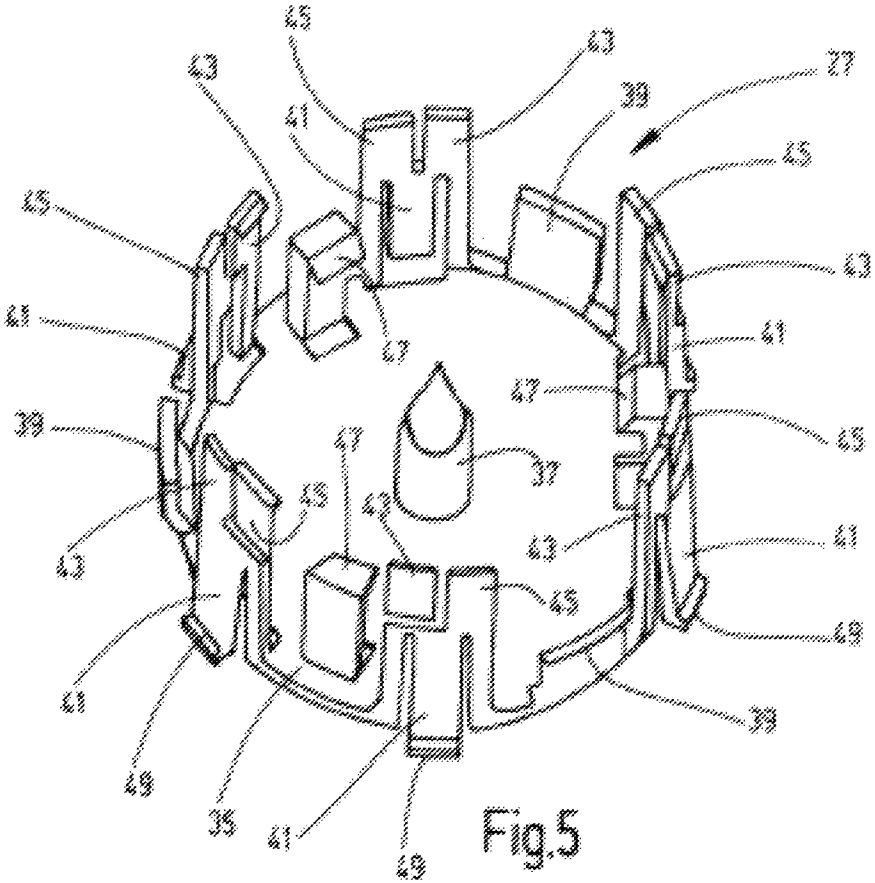
FIG. 5 is a perspective view of the media transfer device that forms part of the connection system of FIG. 1.
Figure 6:
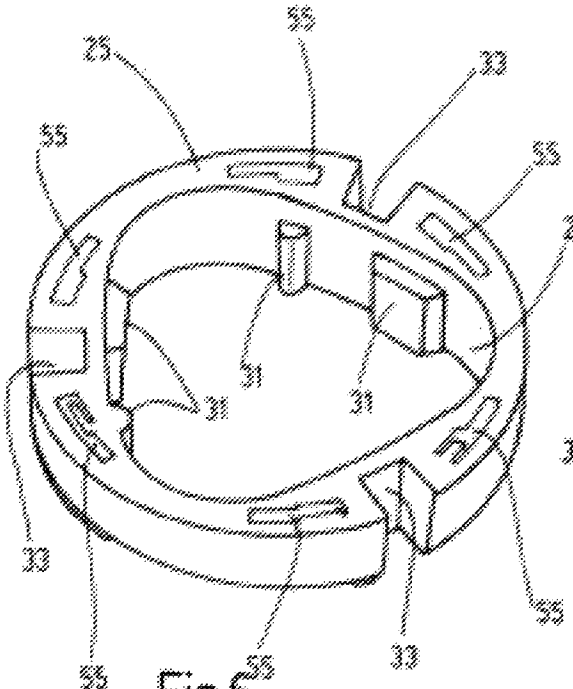
FIG. 6 is a perspective view of the locking element of the connection system of the exemplary embodiment.

Provided as a codeable lock for the lock and key system is an annular body 25 (see in particular FIGS. 6 and 8), which forms a locking element as part of the locking device of the transfer device 27 represented in particular in FIG. 5. For the purpose of inserting the key element formed by the cap section 13, the annular body 25 is provided with an opening 29 that is matched to the circumference of the cap section 13, that is, it has the form of a Reuleaux triangle. The opening 29 is provided on the inside with coding in form of protrusions 31, which match the recesses 21 of the key part on the cap section 13 if the coding fits. The protrusions 31 do not extend to the upper edge of the annular body 26, as shown in FIG. 6, so that when starting to insert the cap section 13 at the beginning of the transfer process an orientation plane is defined, on which the cap section 13 may be brought into the rotating position of the alignment of recesses 21 and protrusions 31. If the coding fits, cap section 13 may be inserted into the opening 29 of the annular body 25. When viewing FIG. 8, the protrusions 31 form heels at the upper end that may be brought in contact with the corresponding heels of the recessed ends of the recesses 21 of the cap section 13. When the container or bottle 5 is moved axially towards the infusion container 1, the cap section 13 brings the annular body 25 with it by necessity.

Figure 4:
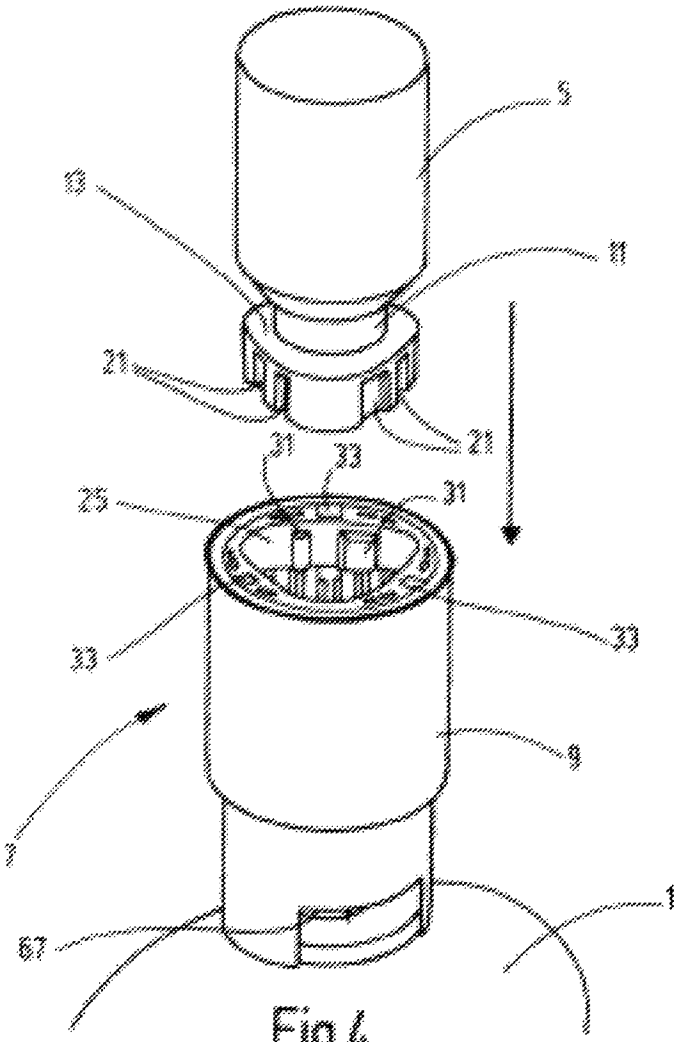
FIG. 4 is a pulled-apart, perspective partial view of the exemplary embodiment, which depicts the state of the container prior to the insertion into the connection system of the transfer system.

FIG. 4 depicts the initial state prior to the start of the transfer process, wherein the annular body 25 is located at the upper end of a sleeve-shaped seat 9 of the connection system 7. As is shown most clearly in FIG. 6, the annular body 25, which forms the locking element, is provided on the outer circumference with continuous axial grooves 33 through which the annual body 25 is guided on axial guide strips (not depicted) of the sleeve-shaped seat 9. The transfer device 27, which is shown separately in FIG. 5, is guided, axially moveable, below the annular body 25 in the sleeve-shaped seat 9 to facilitate its opening movement. As FIG. 5 shows most clearly, the transfer device 27 is provided with a disk 35 that matches the internal diameter of the sleeve-like seat 9 and that serves as support for a centrally located, hollow puncture spike 37. Spike 37 takes the form of a multichannel cannula that is known per se and protrudes on both sides of the disk 35 to be able to perform the opening process by perforating the opening section 50 of the infusion bottle 1 as well as the opening section 48 of the bottle 5. Disposed around the circumference of disk 35 are upright operating elements. Three of these are guide tabs 39, with which the disk 35 is guided during movements at the inner wall of the sleeve-shaped seat 9. Disposed between two subsequent guide tabs 39 are two tabs each, where each is provided with three reeds 41, 43 and 45 that are attached to each other. Furthermore, located above the surface of the disk 35 are inward-pointing latches 47 that facilitate the formation of a snap-action connection, which will be described in greater detail below.

Figure 11:
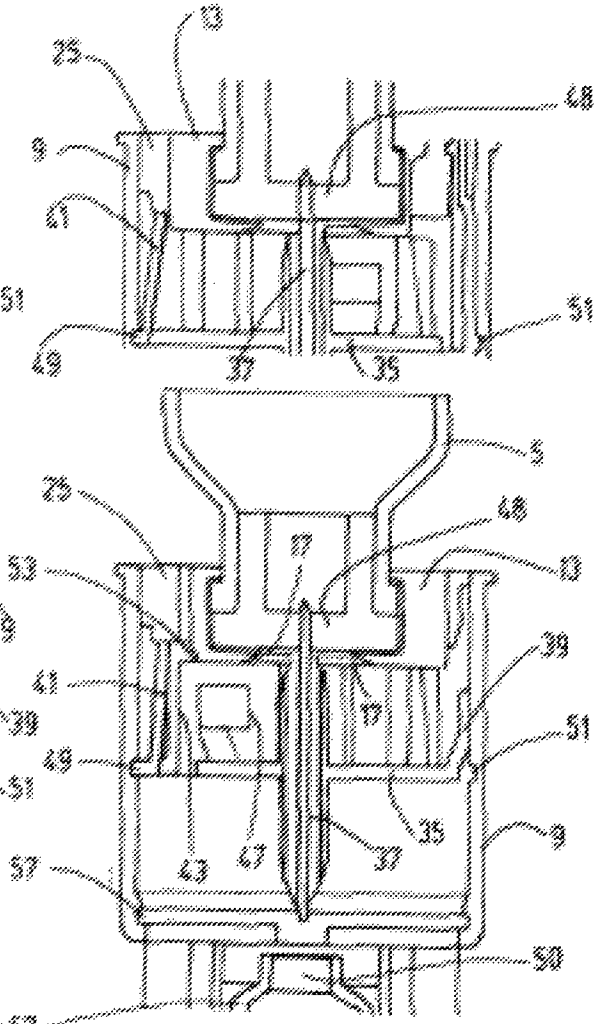
FIGS. 11 to 15 are partial side views in section similar to those in FIGS. 9 and 10, depicting subsequent positions in the transfer process of FIG. 1.
Figure 10:
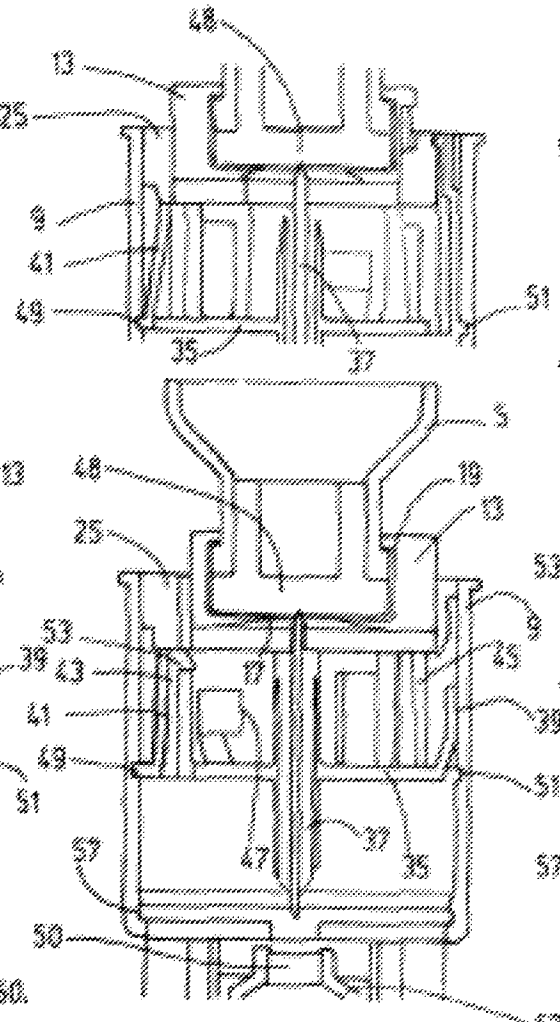
FIG. 10 is a simplified, schematic side view in partial section of a further stage of the transfer process of FIG. 1, wherein, with matching code formations of the key element of the bottle and of the locking element, which serves as lock, the cap section of the bottle is partially inserted into the locking element, and wherein the in the drawing shown as the upper part of the FIG. 10 depicts a cross-sectional plane that is rotated by 90° compared to the depiction in FIG. 9.
Figure 9:
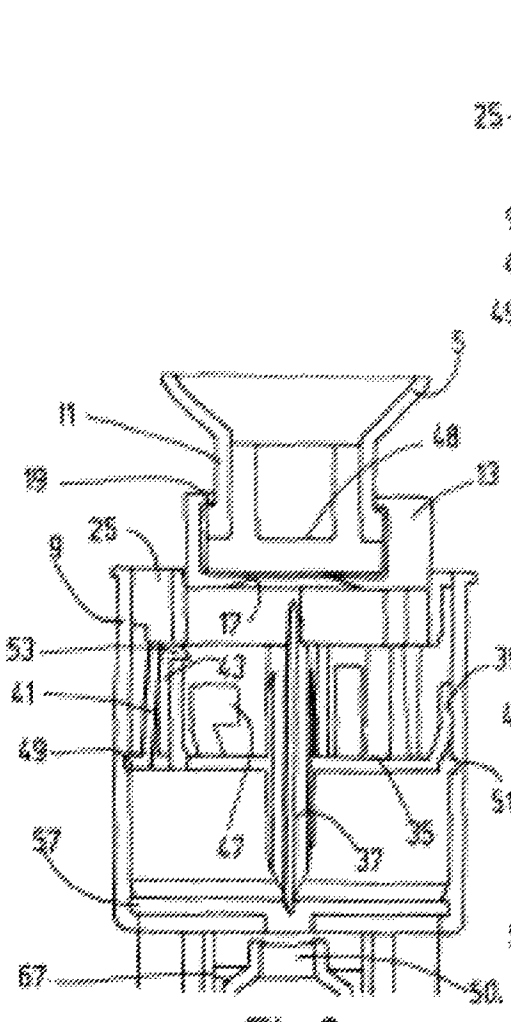
FIG. 9 is a simplified, schematic side view in partial section of the connection system of FIG. 1 that contains the transfer device, and of the allocated opening section of the moveable bottle, wherein the bottle is shown with its cap section in a centered position prior to insertion into the locking element of the connection system.
Figure 14:
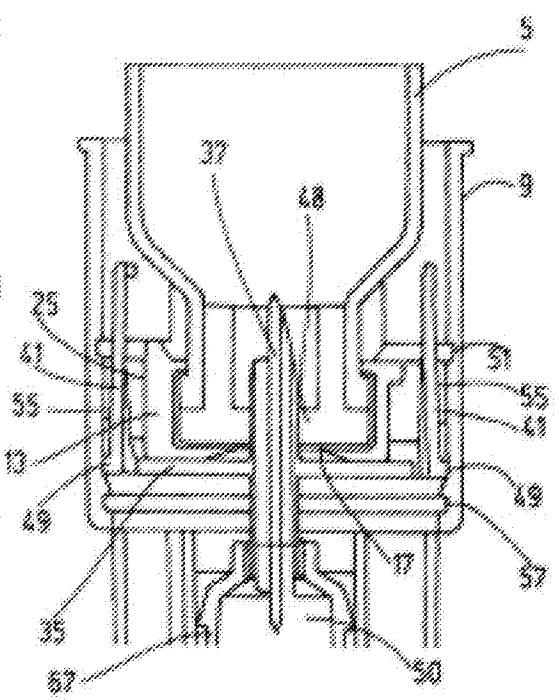
Figure 13:
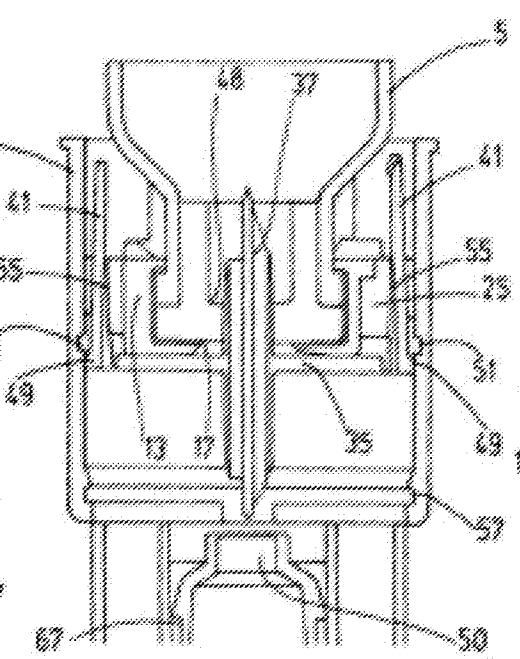
Figure 12:
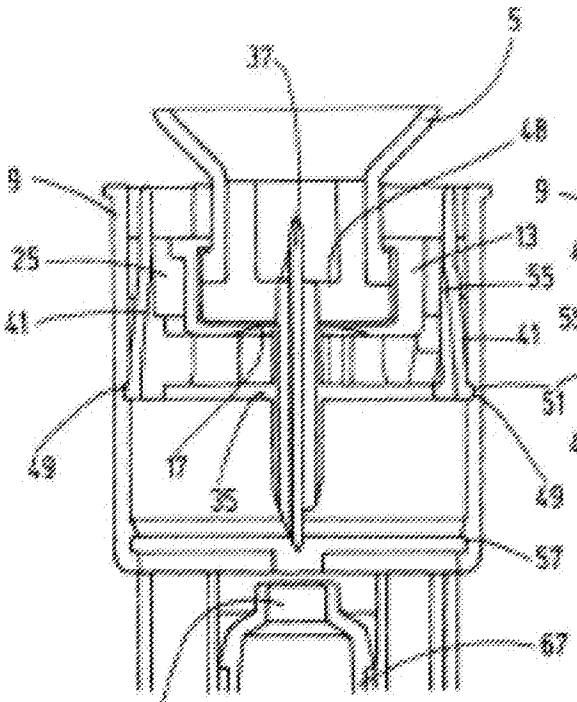

As depicted in FIG. 4, the annular body 25, which forms the locking element of the locking device, is disposed at the upper edge of the sleeve of seat 9. In this instance, the annular body 25 is in a locked state, that is, in a state in which an axial movement is not possible. The transfer device 27, which is located below the annular body 25, is itself locked against axial movement because the disk 35 with the locking catches 49 is locked in a locking groove 51 of the sleeve with the reeds 41, which are braced or biased outwards slightly. Thus, the annular body 25, which acts as locking element, is also in a locked position because the reeds 45 of the upright tabs of the disk 35 prevent the movement of the annular body 25. This state is depicted in FIG. 9. If the code formations of the cap section 13 of the bottle 5 and those of the annular body 25 match, the cap section 13 can be inserted into the annular body 25, as shown in FIGS. 10 and 11. During this movement, the hollow spike 37 perforates the opening section 48 of bottle 5, and the cap section 13 comes into contact with a locating latch 53 on the reeds 43. Through the continued insertion movement of the cap section 13, the reeds 43, 45 are deflected for the unlocking process. Thus, the annular body 25 is moveable relative to the disk 35 of the transfer device 27, wherein the reeds 41, 43, 45 of the tabs are guided such in the guide channels 55 of the annular body 25 that the locking catches 49 on the reeds 41 are lifted out of the locking groove 51 of the sleeve of the seat 9. This state is reached in the depiction of FIG. 13. This allows the bottle 5 with the cap section 13 to be inserted further, as shown in FIG. 14, through which the annular body 25 is also moved. Annular body 25 in turn is in contact with the disk 35 of the transfer device 27 and pulls this one also in for the opening movement (see FIG. 4), through which the hollow puncture spike 37 also perforates the opening section 50 of the infusion container 1. For the transfer process the hollow puncture spike 37 is provided with two transfer channels that extend parallel to the respective puncture direction.

Figure 16:
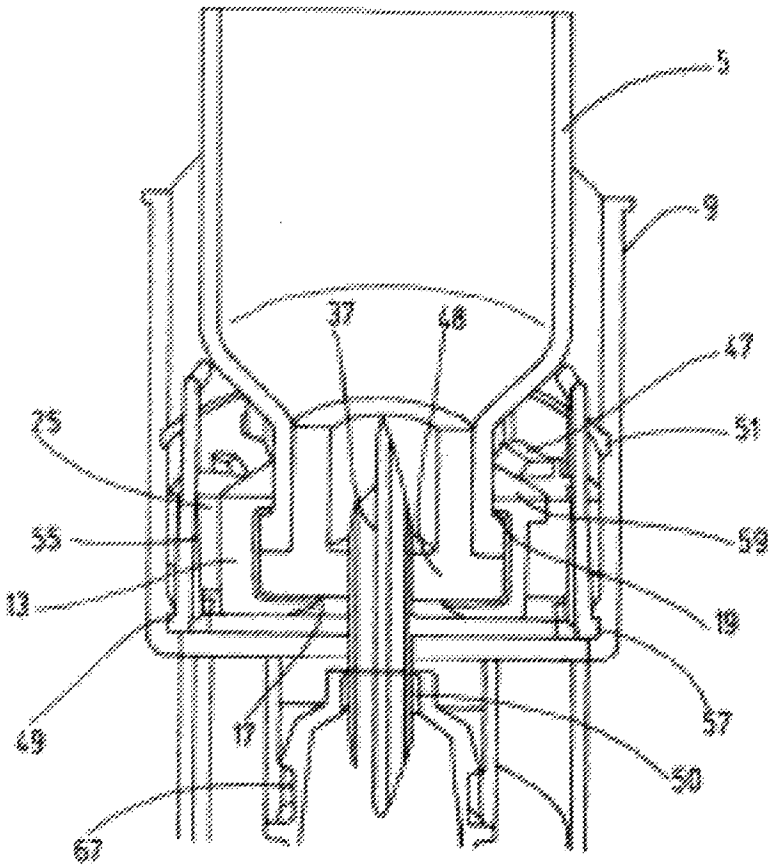
FIG. 16 is a perspective view corresponding to the depiction in FIG. 15.
Figure 15:
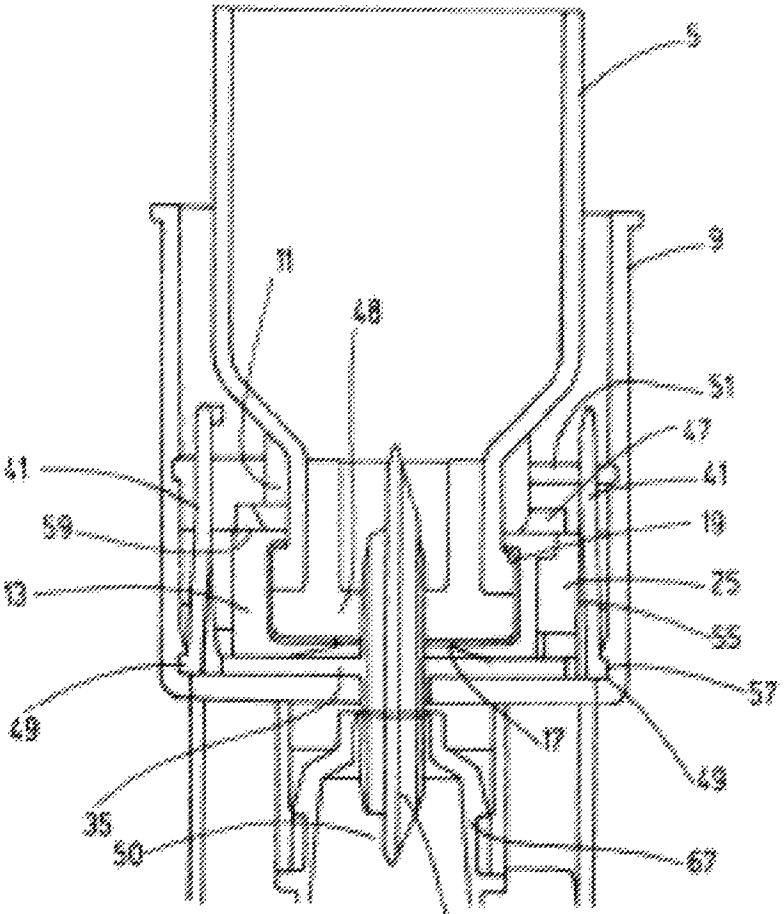
Figure 19:
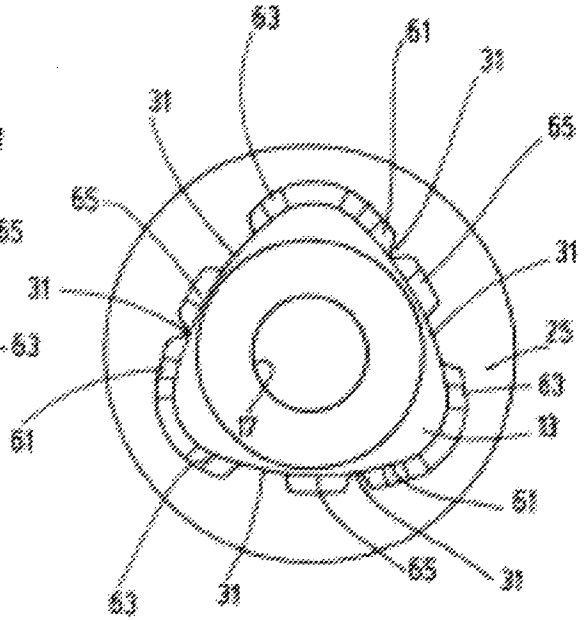
FIGS. 18 & 19 are plan views of the cap section of FIG. 17 inserted into the locking element, which itself is provided with code formations that permit the insertion.

Disposed at the base of the sleeve of seat 9 is a further locking groove 57 to form a latch for the transfer device 27 at the final position at the end of the connection process, as shown in FIGS. 15 and 16. In this end position, the latches 47, which protrude inwards above the disk 35 (see FIG. 5), form a snap-action connection with the cap section 13 by gripping its edge 59 that is free of recesses 21 (see FIG. 16). As a result, the bottle 5 is positively locked in the connection system 7 when it reaches the final position of the transfer process.

Figure 17:
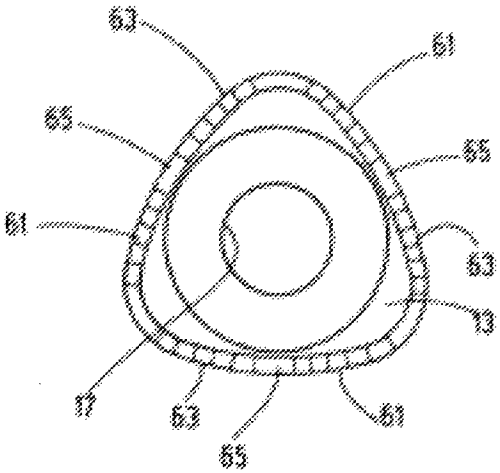
FIG. 17 is a plan view for the purpose of providing greater clarity of the coding principle of FIG. 1, the outline of the cap section of the bottle that forms the key element, wherein on each of the three sides of the Reuleaux triangle two coding sections for two coding subgroups each are shown.

Akin to operating diagrams, the FIGS. 17 to 25 depict the encryption system for the exemplary embodiment shown. FIG. 17 shows that on the circumference of the cap section 13, which has the shape of a Reuleaux triangle with rounded corners, a coding section is provided on each side of the triangle. Each coding section has two groups 61 and 63 with coding positions. The groups 61, 63 are spatially separated from each other by a code-free intermediate space 65. Since each side of the triangle is provided with the same code groups 61, 63 with the same code positions selected for the formation of a corresponding key, the key element may be inserted in three different positions into a lock that is coded the same way. For the present application the coding of code positions of one of the groups 61, 63 is characteristic for the fill volume of the corresponding bottle 5, whereas the other group 61 or 63 represents the content type of a container. As already indicated, in the present example the coding on the cap section 13 is provided by recesses 21 within the groups 61, 63. The diagrammatic representation of FIG. 17 depicts the blank state, without coding through recesses 21.

In the present example the coding in the respective group 61 characterizes the kind of content of a container, for example the kind of solvent present in the infusion bottle 1, whereas the coding of group 63 signifies a volume, for example the volume of a solvent, to which a substance is to be added, or is permitted to be added, that is present in the bottle 5. On the annular body 25, which forms the lock, the protrusions 31 characterize in a corresponding manner the volume of the infusion bottle 1 for the respective code groups 61, 63, or the type of content of a container, for example, the formulation of the solvent present in the infusion bottle 1.

Figure 18:
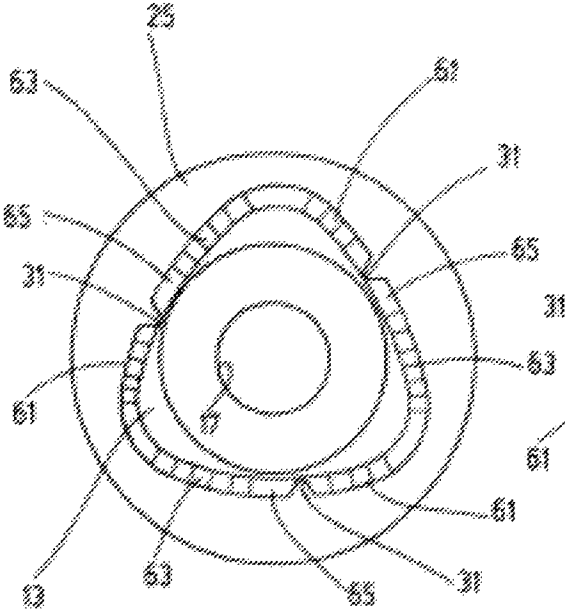

FIG. 18 shows an example in which the cap section 13 signifies, through a recess 21 in a first code position of group 61, that the bottle 5 is reserved for admixture to a content A of bottle 1, whereas the group 63 has no recess 21, which signifies that the bottle 1 contains a certain solvent volume. In the example shown in FIG. 19, a recess 21 is formed in the groups 63 that spans across multiple coding positions, which signifies a different solvent volume, whereas a recess in the groups 61 in a coding position that differs from that of FIG. 18 signifies a different solvent type, for example a solvent B, for example 50 ml, corresponding to the recess in group 63.

Figure 22:
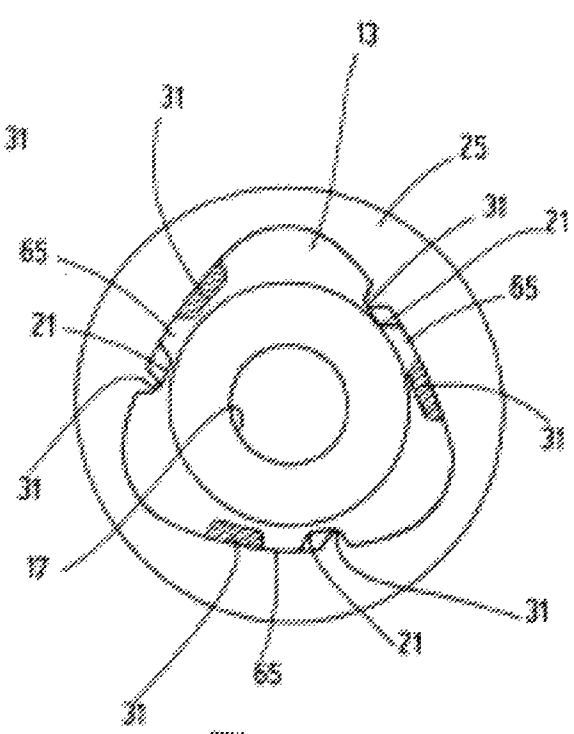
FIGS. 20 to 22 are plan views of two further coding examples according to exemplary embodiments of the invention similar to those in FIGS. 17 to 19.
Figure 21:
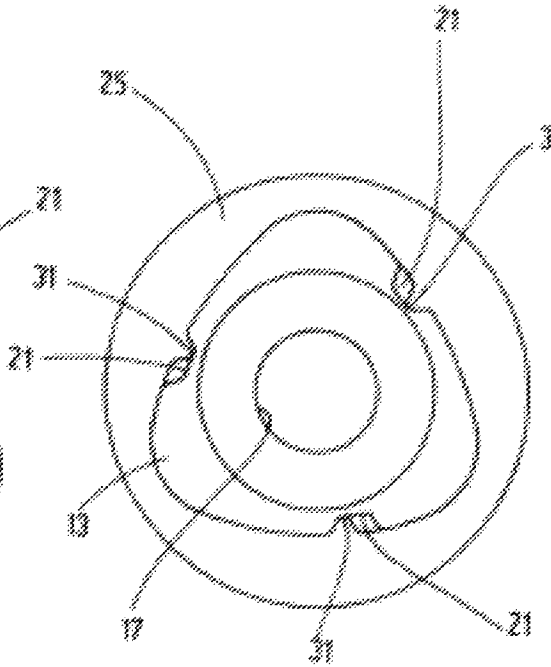
Figure 20:
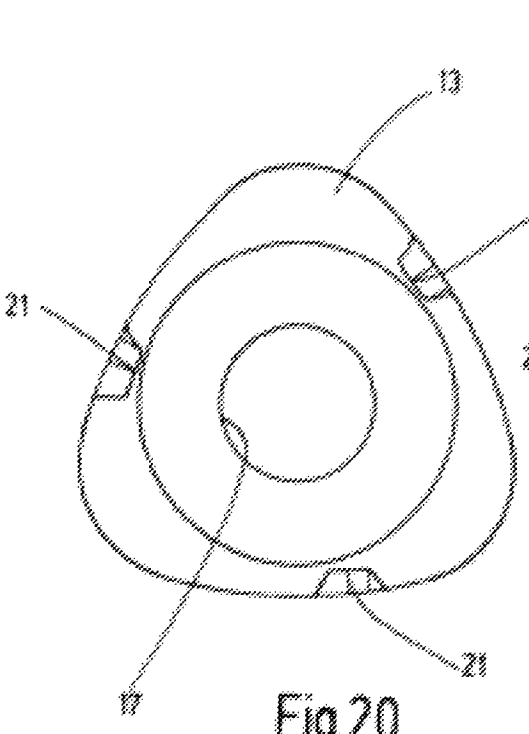

FIGS. 20 to 22 show examples in which the bottle 5, through wider recesses 21 in groups 61, signifies that it is reserved for a supply of media to a solvent A as well as to a solvent B in bottle 1. Through lack of a recess 21 in the groups 63 is signified at the same time that the additive is only designed for a certain solvent volume in bottle 1, for example 250 ml. The example of FIG. 21 shows accordingly that the bottle 5 can be combined with a bottle 1 that contains the solvent A with 250 ml. As shown in FIG. 22, however, the combination is not possible with a bottle 1 that contains the solvent B with a different volume, for example 50 ml.

Figure 25:
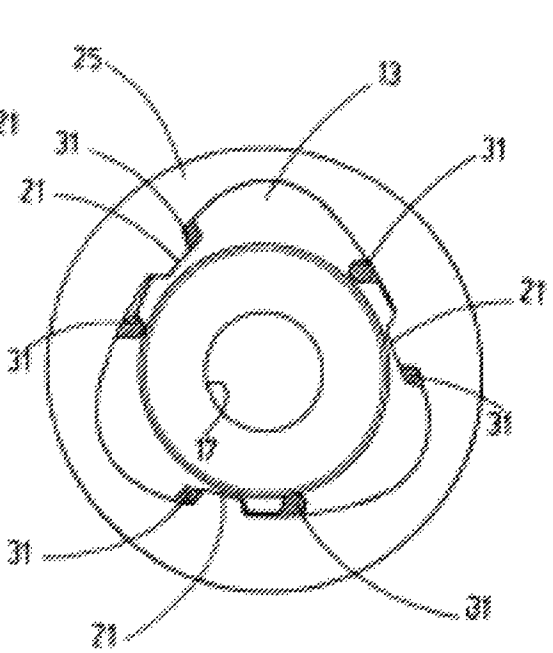
FIGS. 23 to 25 are plan views of two further coding examples according to exemplary embodiments of the invention.
Figure 24:
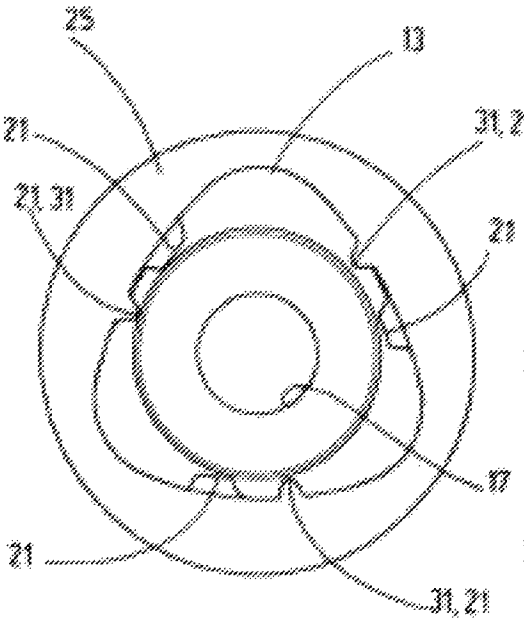
Figure 23:
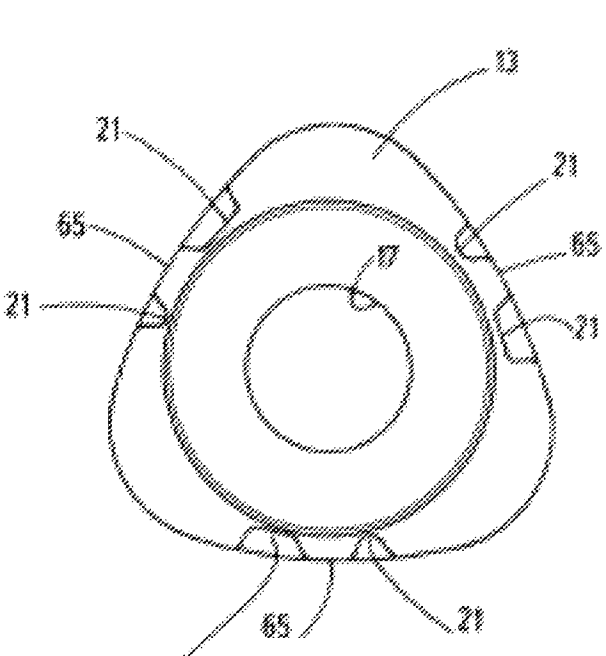

Corresponding to FIGS. 20 to 22, the FIGS. 23 to 25 show examples in which the bottle 5 signifies through a recess 21 in only one coding position of group 61 that the bottle 5 is only designed for a solvent A in bottle 1. However, a recess 21 that extends across two coding positions of group 63 signifies that the combination is permitted over a larger volume range, for example for 100 to 250 ml of solvent. As shown in FIG. 24, the bottle 5 fits an infusion bottle with the solvent A at 250 ml. In contrast, FIG. 25 shows that the combination is excluded for a different solvent B as well as for a different solvent volume.

Figure 28:
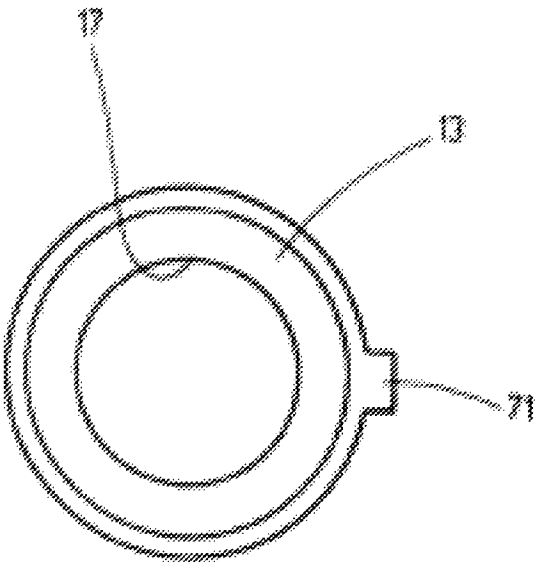
FIGS. 26 to 28 are diagrammatic plan views showing other possible, different outline shapes for the key element on the cap section of the moveable bottle according to exemplary embodiments of the invention.
Figure 27:
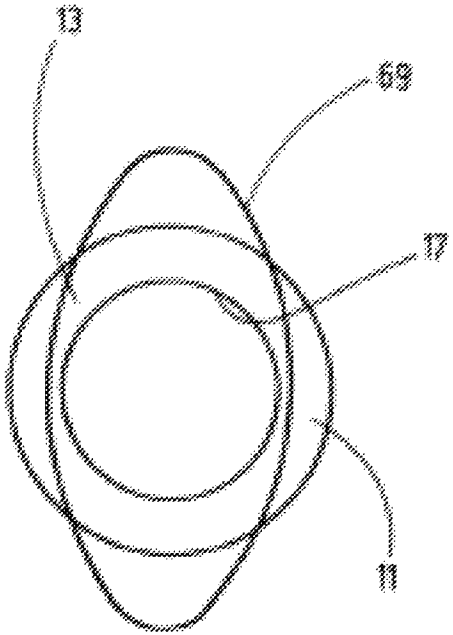
Figure 26:
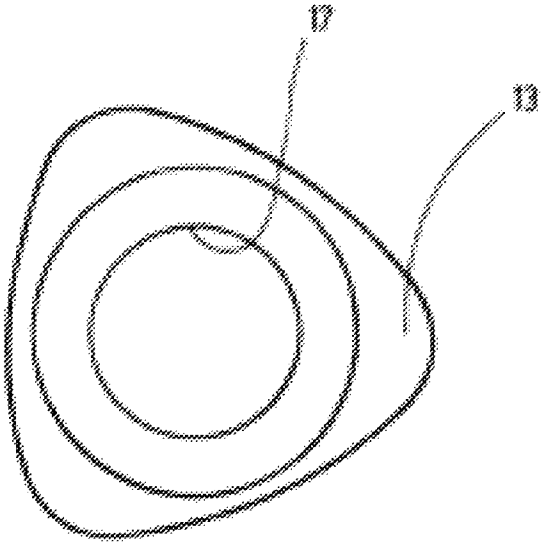

FIGS. 26 to 28 depict diagrammatically further possibilities of the outline design of the key element, which is shown uncoded. FIG. 26 shows the triangular shape that has been adopted for the description of the exemplary embodiment, whereas FIG. 27 has a different, non-circular outline in form of a type of ellipse 69. It is also possible with a circular outline, as shown in FIG. 28, to provide irregular form features, such as a pattern of protrusions and recesses, of which only one protrusion 71 is shown in FIG. 28, which again can be provided in groups separated from each other. In the instance of a circular configuration, the lock and key connection is only possible through a single unambiguous, relative insertion position, whereas with the ellipse 69, shown in FIG. 27, coding groups may be provided on both long curved sides, so that the lock and key connection is possible for two relative insertion positions. To form matching coding groups it is also possible to use recesses instead of protrusions on one component, which are then matched to the protrusions of the other component.

Figure 29:
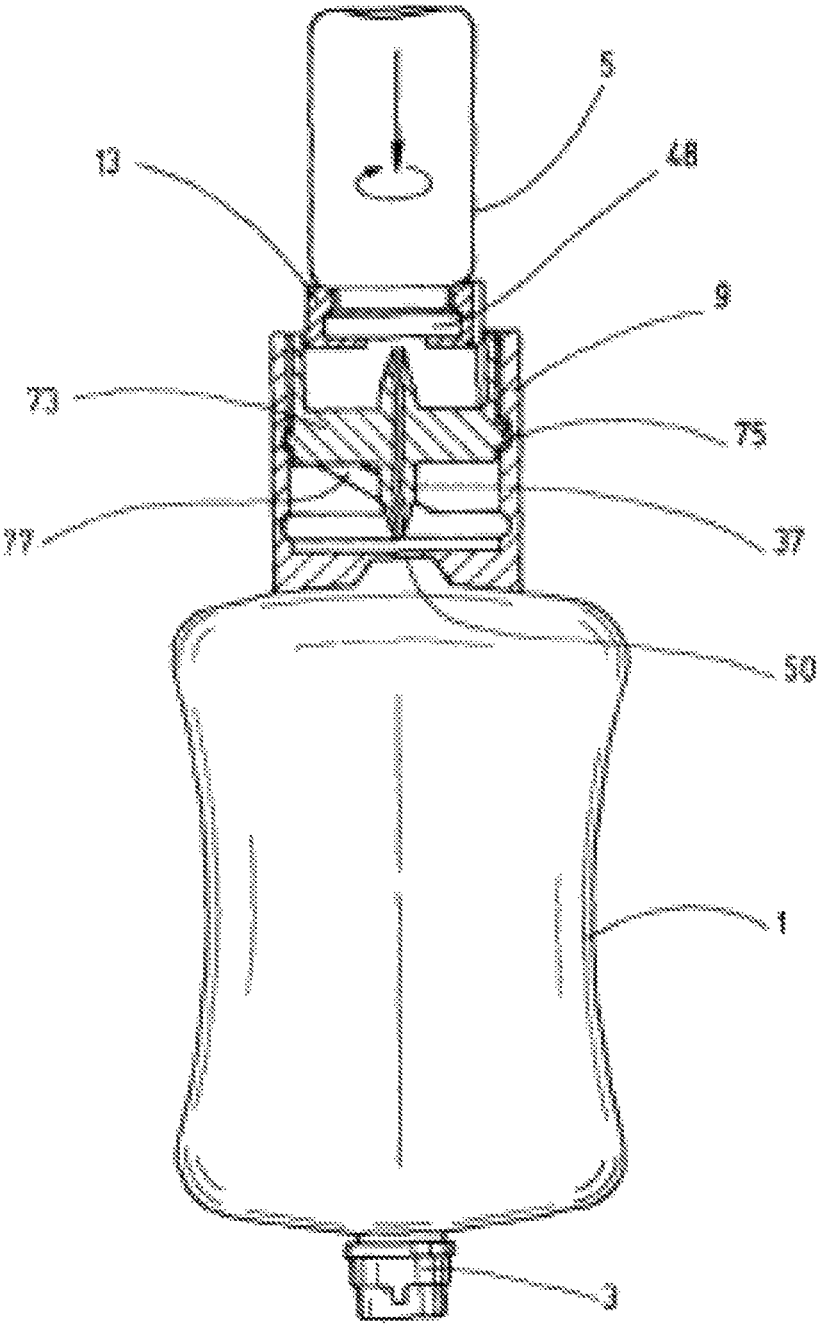
FIG. 29 is a highly schematic, side view partially in section of a modified exemplary embodiment of the transfer system for containers according to the invention.

The FIG. 29 shows in a purely schematic and simplified representation an exemplary embodiment in which the body 73 of the transfer device, which supports the hollow puncture spike 37, forms a kind of pot. Seat 9 forms with its inner wall 75 the lock element into which the cap element 13 of the bottle 5 may be inserted, with matching coding, in such a way that, when the cap element 13 presses against the body 73, cap element 13 moves the body 73 for the perforation process. Since in this movement the body 73 is guided with its circumferential rib 75 in a threaded path 77 of the seat 9, the perforation process takes place advantageously in a rotational movement of the hollow puncture spike 37.

Figure 30:
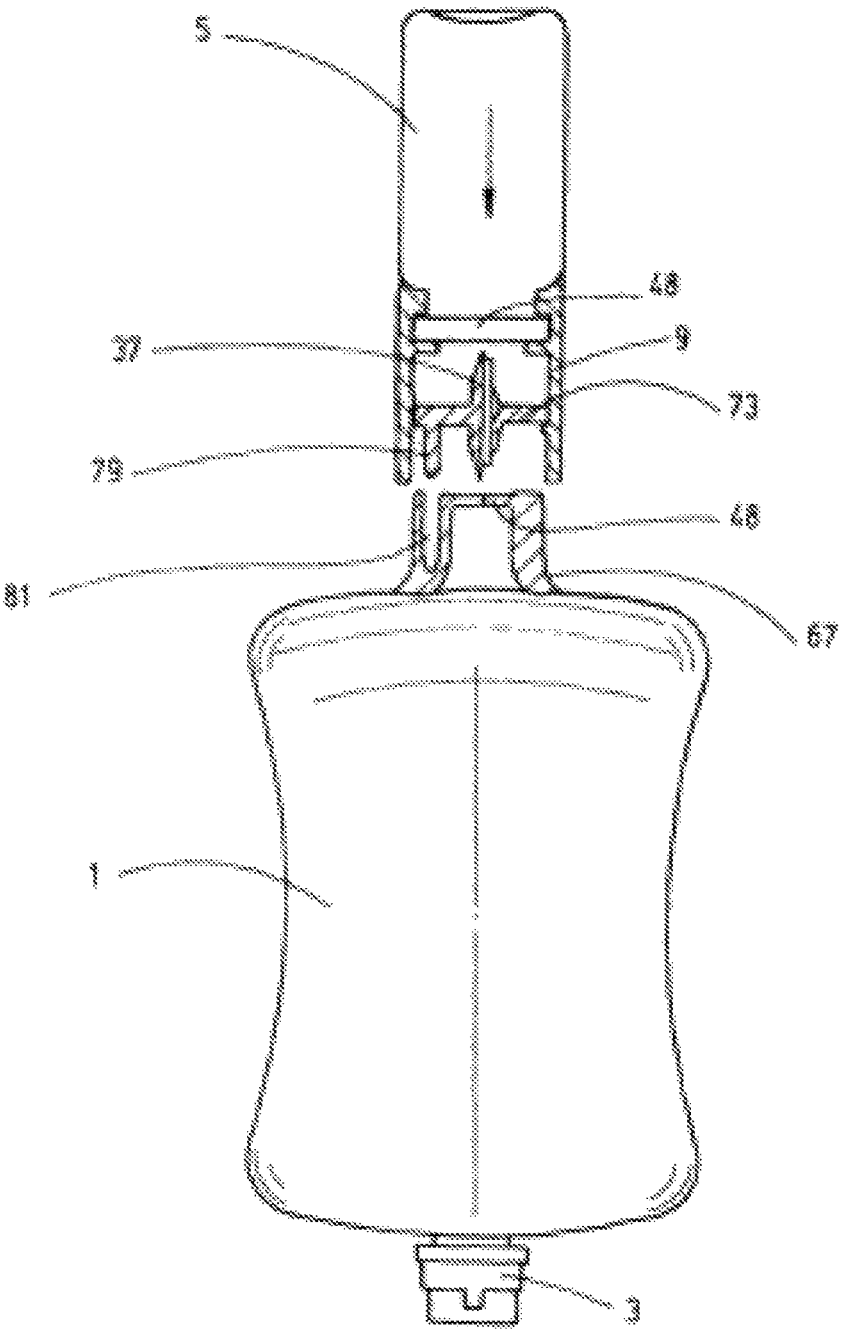
FIGS. 30 & 31 are highly schematic, side views of a third and fourth exemplary embodiments, respectively, according to the invention.

The FIG. 30 shows in a purely schematic and simplified representation a further exemplary embodiment of the lock and key design. In this example, the sleeve body, which forms the seat 9 of the connection system, as well as body 73 of the transfer device that supports the hollow puncture spike 37 are already pre-assembled on the bottle 5, but its opening section 48 is not yet perforated. The coding of the lock and key system is provided by a pin 79 or multiple pins on the body 73, which pin or pins may be inserted into corresponding bore holes 81, which are formed as lock on the neck part 67 of the bottle 1 in a coded arrangement.

Figure 32:
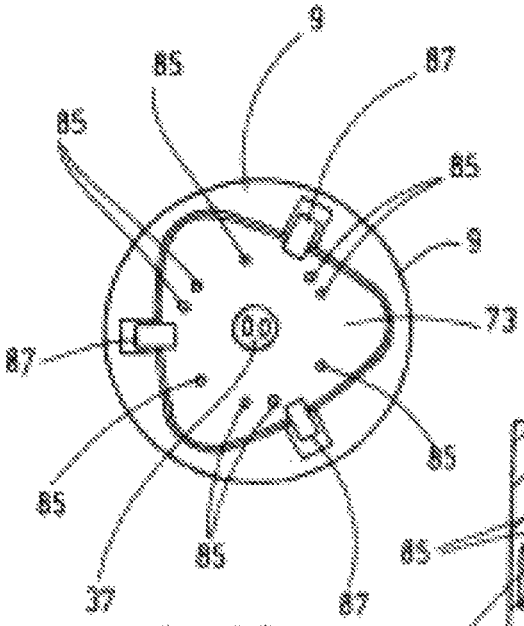
FIG. 32 is a plan view in section of the transfer device of the exemplary embodiment of FIG. 31.
Figure 31:
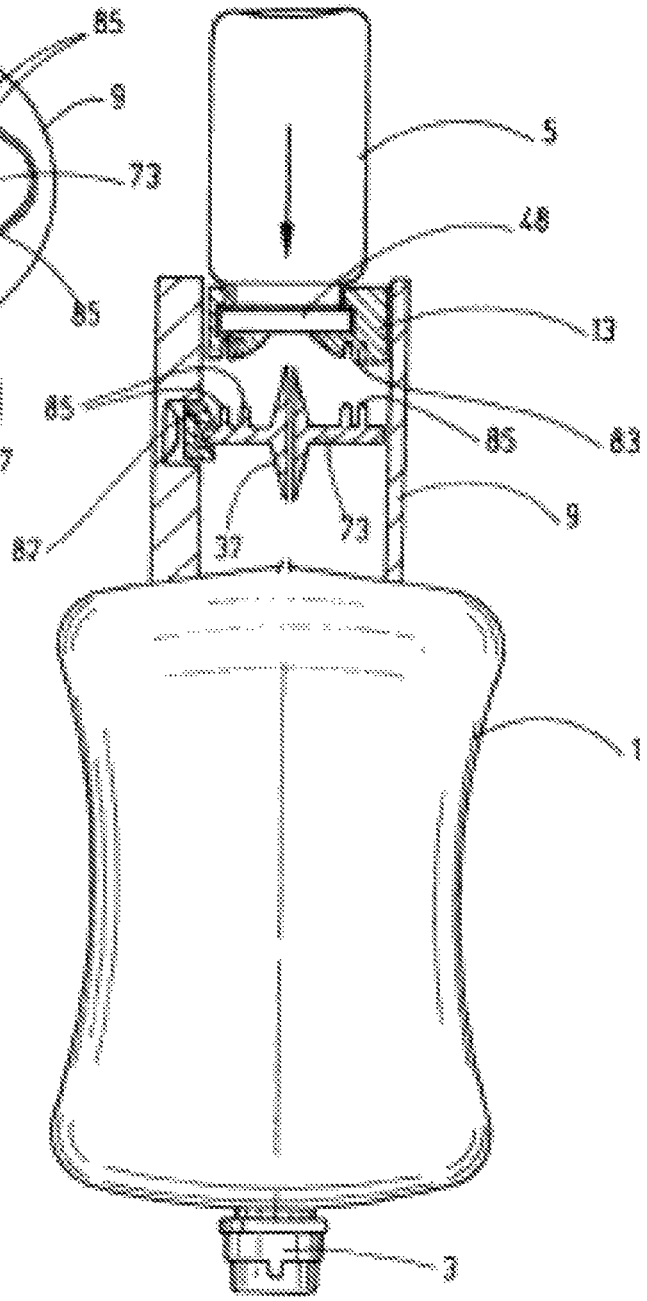

The exemplary embodiment shown in FIGS. 31 and 32 provides as key on the cap section 13 of the bottle 5 a pattern of axial bore holes 83 and a corresponding pattern of pins 85 on the disk-shaped support 73 of the hollow puncture spike 37. The lock element in this example is therefore integrated into the support 73 as a single piece. With matching coding of bore holes 83 and pins 85, the cap element 13 may be placed against the spring-loaded locking bars 87 in order to release the locking of the support 73 on the seat 9 so that the support 73 is moveable through the insertion of the bottle 5 for the connection process. Through adaptation of the length of the cap element 13 or the length of the pins 85 respectively in relation to the protrusion of the locking bars 87 above the pins 85 it may be set whether the support 73 is first moved towards the bottle 1 during the connection process and penetrated and only after that the bottle 5, or whether the bottle 5 is penetrated first and then bottle 1. If the locking bars 87 protrude much above the pins 85, the support 73 is first unlocked from the locking bars 87 and a movement of the support towards the bottle 1 takes place. Since the penetration force of the elastomer plug 48 of bottle 5 is greater than the penetration force of the bottle 1, the bottle 1 is penetrated first by the hollow puncture spike 37. Analogously to the already in detail described previous examples, it is possible to also integrate locking and/or guiding elements into support 73 similar to those shown in FIG. 5 and to provide corresponding grooves in the seat 9.

Figure 34:
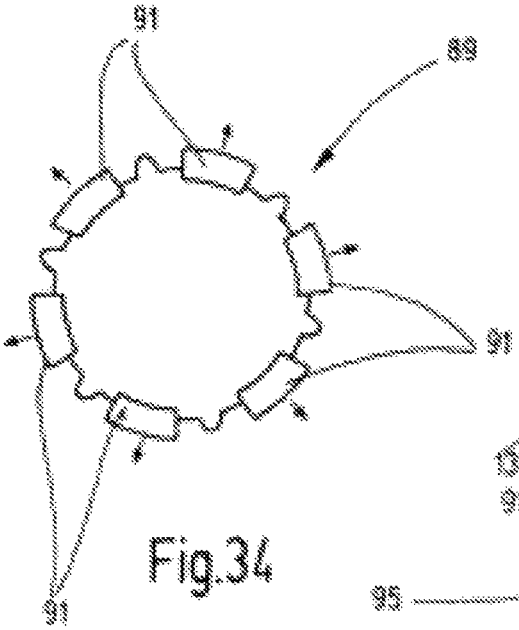
FIG. 34 is a schematic, simplified, plan view of the locking element of the exemplary embodiment of FIG. 33.
Figure 33:
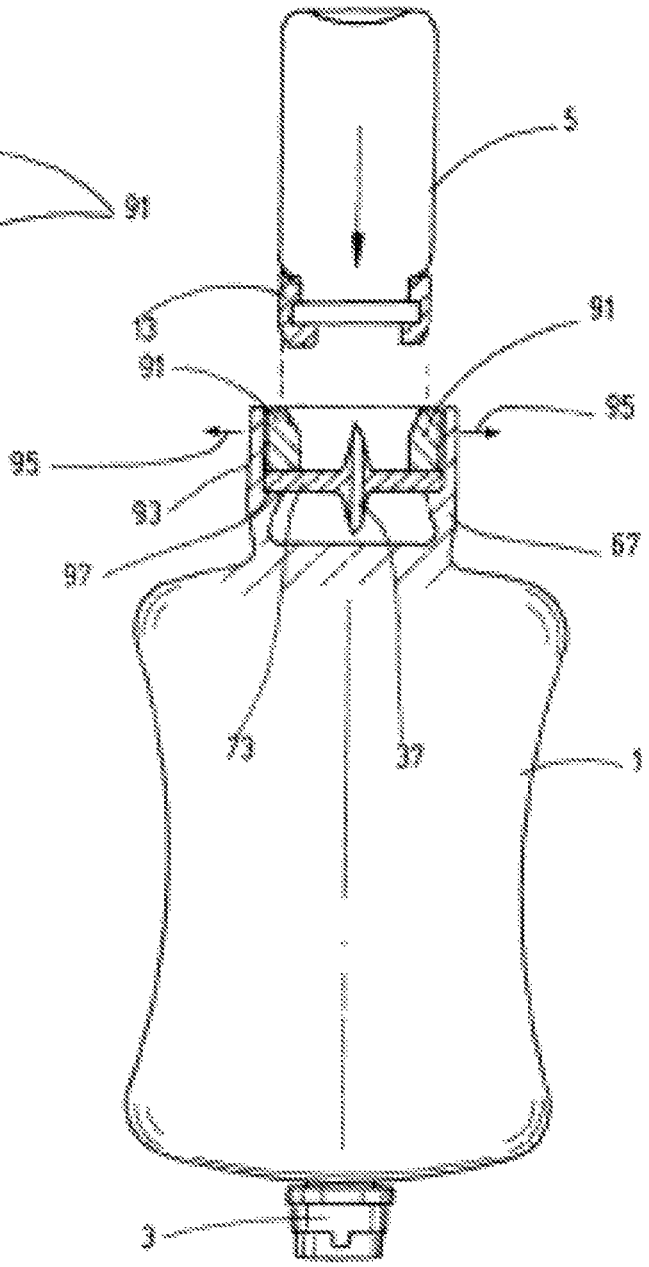
FIG. 33 is a side view in partial section of a transfer device according to a further exemplary embodiment of the invention.

The exemplary embodiment depicted in FIGS. 33 and 34 provides for the unlocking of the body 73, which supports the spike 37, a ring 89, shown in detail in FIG. 34, made from pressure elements 91 that are elastically connected to each other. These pressure elements 91 may be spread apart by the insertable cap element 13 of the bottle 5 with matching coding in such a way that the rim 93 of body 73, formed on bottle neck 1, is expanded, as indicated with arrows 95, so that the body 73 is released from a step 97 of the rim 93 for the opening movement.

With the solution according to the invention, it is possible to connect all kinds of media-transferring and media-containing containers, which broadly speaking also includes tube systems, to couple them in a sterile and fluid-tight manner for the purpose of exchanging media.

While various embodiment have been chosen to illustrate the invention, it will be understood by those skilled in the art that various changes and modifications can be made therein without departing from the scope of the invention as defined in the claims.

The invention claimed is:

1. A transfer system for conveying media, the transfer system comprising:

a first container with a first medium therein;

a second container with a second medium therein;

a connection coupling said first and second containers and allowing transfer of said first medium from said first container into said second container, said connection including a mechanical lock and key encryption having a first key element with a physical coding on said first container and having a locking element locking on the connection, said first key element being at least one of recesses or protrusions on a circumference of a cap section of said first container, said locking element having a second key element with a physical coding formed by at least one of recesses or protrusions being formed on a wall of an opening of said locking element and being complementary to said first key element, each said coding having first and second subgroups with each of said first and second subgroups having at least one of said recesses or one of said protrusions, being spatially separated from one another and being indicative at least one characteristic of the respective one of the first and second media, the characteristic of each of the first and second media involving an ingredient, a volume or an ingredient quantity thereof.

2. A transfer system according to claim 1 wherein said locking element is movable from a locked position preventing connection of said first and second containers to an unlocked position permitting connection of said first and second containers through engagement of said first and second key elements that are complementarily coded.

3. A transfer system according to claim 2 wherein said locking element prevents movement of a hollow puncture spike of said connection to an opening position connecting said first and second containers in fluid communication in the locked position of said locking element.

4. A transfer system according to claim 1 wherein said first key element surrounds a perforable opening section of said first container.

5. A transfer system according to claim 1 wherein said cap section is provided at an end face thereof with irregular form features forming said first key element.

6. A transfer system according to claim 1 wherein said locking element comprises an opening receiving said cap section with the recesses or protrusions thereof facing an interior of said opening.

7. A transfer system according to claim 6 wherein a latching member engages said opening of said locking element, said latching member being unlocked by said cap section inserted through said opening of the locking element to release a locked state of a hollow puncture spike of said connection to connect said first and second containers in fluid communication.

8. A transfer system according to claim 7 wherein the coding comprises recesses or protrusions in said opening of said locking element.

9. A transfer system according to claim 8 wherein the at least one of the recesses and protrusions on said cap section and said locking element extend along a longitudinal axis of said first and second containers.

10. A transfer system according to claim 1 wherein each of said cap section and locking element is made as a single unitary piece, said locking element being annular.

11. A transfer system according to claim 1 wherein said cap section and an opening in said locking port receiving said cap section have polygonal or Reuleaux triangular outer configurations with the at least ones of the recesses or protrusions being on each side thereof.

12. A transfer system according to claim 1 wherein said cap section comprises a removable cover extending over a perforable opening in said cap section.

13. A transfer system according to claim 12 wherein said removable cover is a foil capable of being radiated by high-energy radiation.

14. A transfer system according to claim 1 wherein the coding of said cap section is provided by an outer shape of said cap section.

15. A transfer system according to claim 1 wherein said cap section has an outer transverse diameter equal to or smaller than an outer transverse diameter of said first container.

16. A transfer system according to claim 1 wherein said cap section is at least partially rotatable relative to said first container.

17. A transfer system according to claim 1 wherein said cap section forms a part of a multi-piece sealing system sealing said first container after freeze drying.

18. A transfer system according to claim 1 wherein the recesses or protrusions on each of said cap section and said locking element have different dimensions.

19. An encryption system for transferring media in a first container to a second container, the encryption system comprising:

a mechanically coded first key element movable on the first container; and a mechanically coded second key element on a locking element of a connector mountable on the second container, said connector being locked in a functionally disabled state and being unlocked when coding of said first key element matches and is engaged with said second key element, said first key element having at least one of a recesses or protrusions on an outer circumference of a cap section mountable on the first container, said second key element being at least one recesses or protrusions on a circumferential wall defining an opening in the locking element, said first and second key elements being complementary allowing said cap section to be received in said opening of said locking element, coding of each of said first and second key elements having at least first and second subgroups with each of said first and second subgroups of each of said first and second key elements having at least one of the recess or the protrusion, said first and second subgroups of each of said first and second key elements being spatially separated from one another and being indicators of different characteristics of a medium in each of the respective first and second containers.

20. An encryption system according to claim 19 wherein the recesses or protrusions of each of the first and second key elements have different dimensions.

21. An encryption system according to claim 19 wherein said locking element comprises a hollow puncture spike on a disk shaped support and a spring loaded latching that is unlockable when the first and second key elements match and engage.

* * * * *